United States Patent [19]

Fukukawa et al.

[11] Patent Number: 4,854,769

[45] Date of Patent: Aug. 8, 1989

[54] SYSTEM FOR PAVING INCLINED AND/OR CURVED SURFACES

[75] Inventors: Mitsuo Fukukawa, Saitama; Masayuki Yazawa, Chiba; Kazumitsu Asai; Yoshiharu Okamoto, both of Saitama; Kouhei Mio, Kanagawa, all of Japan

[73] Assignees: Kajima Corporation, Tokyo, Japan; Kasima Road Company, Tokyo, Japan

[21] Appl. No.: 155,905

[22] Filed: Feb. 16, 1988

[30] Foreign Application Priority Data

Feb. 26, 1987 [JP] Japan ..... 62-41500
Feb. 26, 1987 [JP] Japan ..... 62-26428[U]

[51] Int. Cl.[4] ..... E01C 19/00; E01C 19/22; E01C 23/07

[52] U.S. Cl. ..... 404/72; 404/84; 404/96; 404/118

[58] Field of Search ..... 404/84, 96, 101, 104, 404/118–120, 72, 75

[56] References Cited

U.S. PATENT DOCUMENTS

| | | | |
|---|---|---|---|
| 2,094,910 | 10/1937 | Baily | 404/96 |
| 2,890,632 | 6/1959 | Madison et al. | 404/96 |
| 2,999,433 | 9/1961 | Baltes | 404/96 |
| 3,559,544 | 2/1971 | Miller | 404/96 |
| 3,602,113 | 8/1971 | Davin et al. | 404/96 X |
| 3,953,145 | 4/1976 | Teach | 404/84 |
| 4,473,319 | 9/1984 | Spangler | 404/84 X |
| 4,621,944 | 11/1986 | Jordense | 404/96 X |

FOREIGN PATENT DOCUMENTS

| | | | |
|---|---|---|---|
| 2260662 | 9/1975 | France | 404/84 |

*Primary Examiner*—Thuy M. Bui
*Assistant Examiner*—John F. Letchford
*Attorney, Agent, or Firm*—Beveridge, DeGrandi & Weilacher

[57] ABSTRACT

An inclined roadbed is paved by vehicles which are connected by wires to uphill anchor vehicles. A paving vehicle on the inclined surface has a device for projecting a laser beam to a beam-receiving device on its respective anchor vehicle. The height of the wire connection point on the anchor vehicle is changed in response to signals from the beam-receiving device, so as to equalize the forces exerted on the inclined surface by the left and right sides of the paving vehicle. For paving surfaces such as automobile test tracks which have compound curvatures, a pavement laying apparatus has a curved surface formed by a plurality of interconnected screed plates which are each connected to a respective screw jack. A microcomputer stores data representing the desired shape of the pavement at different points along the travel path of the apparatus. Signals representing the travel distance of the apparatus are sent to the microcomputer, and the microcomputer sends output signals which control the jacks to produce a pavement surface which has the desired shape.

10 Claims, 6 Drawing Sheets

FIG. 4
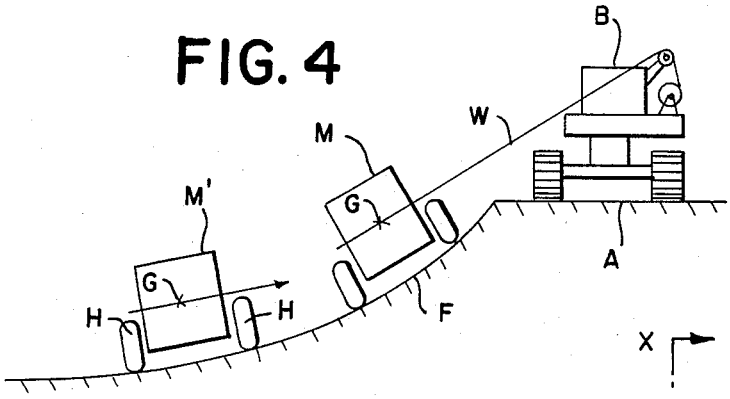
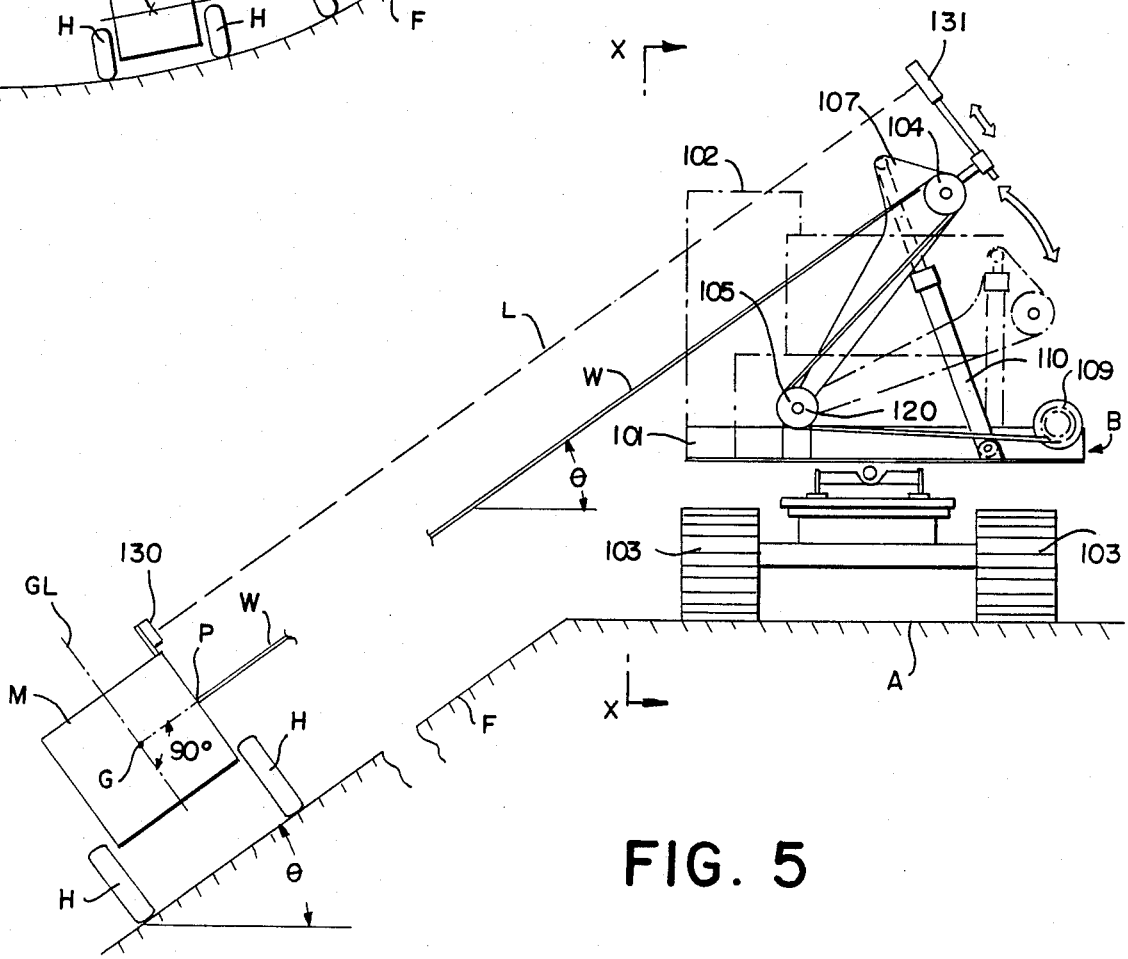
FIG. 5

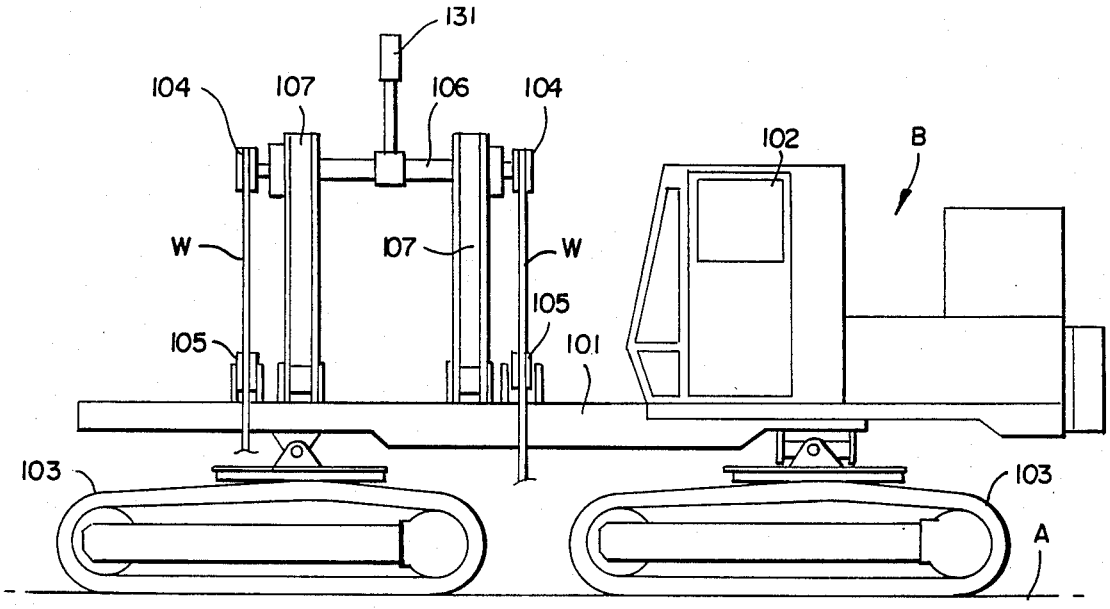
FIG. 6
FIG. 7
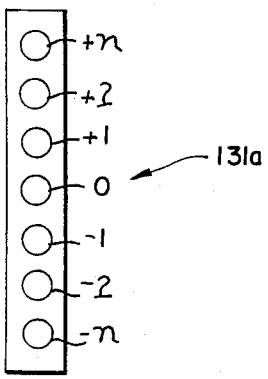
FIG. 8
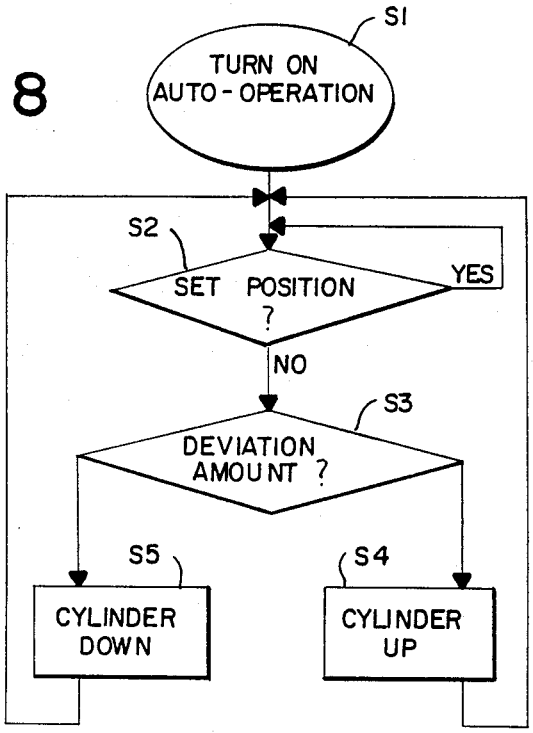

SYSTEM FOR PAVING INCLINED AND/OR CURVED SURFACES

BACKGROUND OF THE INVENTION

The present invention relates to a method and apparatus for supporting a paving vehicle on an inclined surface. Asphalt finishers, steel rollers and tire rollers are all typical paving vehicles.

Also, the invention relates to a method and apparatus for paving a three-dimensional curved surface and, more particularly, to a system for uniformly laying a paving material such as asphalt onto the three-dimensional curved surface.

A slope face such as a test course for automobiles is paved by laying asphalt on the slope face with an asphalt finisher and then compacting the asphalt with a steel roller, tire roller, or the like. These steps are well known. For example, as shown in FIG. 1, an asphalt finisher C, a steel roller D, and a tire roller E, are supported by wires W from anchor vehicles B which run on a top end portion A. The asphalt finisher C, steel roller D, and the tire roller E run on the slope face F, thereby paving the surface of the inclined slope face. In the diagram, T denotes a dump truck and R indicates a machine for laterally transporting a paving material such as asphalt or concrete.

When paving machines on an inclined surface are supported by wires, an improper supporting method can result in nonuniformity of the paved surface and a deterioration of its working quality. However, hitherto, a satisfactory countermeasure has not been realized. For example, FIG. 2, illustrates the case where a paving machine M is supported on the inclined surface F by the wire W from an anchor vehicle B. A fixed point P of the wire is offset by a distance l from the position of the center of gravity G of the paving machine M, so the paving machine is subjected to a moment $M=T\cdot l$ which generates uneven loads in the wheels H and adversely influences the finished state of the paved roadbed.

On the other hand, as shown in FIG. 3, when the fixed point P of the wire is located on the extension line of the center of gravity G, no problem will be caused if an angle $\theta$ between the supporting direction of the wire W and the inclined surface F coincides with this direction. However, if the supporting angle of the wire increased by an angle $\alpha$ greater than the angle $\theta$ during running, the component of force $J=T \sin \alpha$ occurs. The loads of the right and left wheels H of the paving machine M are unbalanced. The wheel with a smaller load can slip and the paved surface becomes rough. In the worst case, the paving apparatus M cannot run. The working efficiency deteriorates and the paving quality deteriorates.

In levees and similar structures, where the angle of inclination of the inclined surface is constant, the problems of unbalanced wheel loads can be avoided by presetting the supporting direction of the wire. However, as shown in FIG. 4, when the slope face F is curved as in an automotive test course, the inclination continually changes in directions which are transverse and longitudinal of the test course. Accordingly, the foregoing problems will occur if some countermeasures are not taken.

Asphalt finishers for finshing curved roadbed surfaces have been disclosed in the Official Gazette of Japanese patent publication No. 38530/78 and the Official Gazette of Japanese utility model laid-open publication No. 85105/80. However, these prior devices have shortcomings in the respect that manual operation is needed to pave surfaces which have complicated curvatures. This requires skilled and experienced operators in order to achieve the desired degree of accuracy.

It is an object of the present invention to provide an apparatus for supporting a paving machine which avoids the foregoing problems, even when the inclination angle of the slope face changes, as is the case in an automative test course.

It is also an object of the invention to provide a system for paving a three-dimensional curved surface which can provide high accuracy without manual operation.

SUMMARY OF THE INVENTION

In one respect, the invention pertains to a method and apparatus involving an anchor vehicle which supports a paving vehicle on an inclined surface by means of a wire. The paving vehicle has a light projecting apparatus which directs a beam of light, preferably a laser beam, at a beam-receiving means located on the anchor vehicle. One of the vehicles, preferably the anchor vehicle, has means for adjusting the height of the wire extending therefrom, and this height adjustment means is moved vertically when the position of the light beam received by the beam-receiving means deviates from a preset position. By virtue of this arrangement, the forces exerted by the paving vehicle on the inclined surface are equal for the left and right sides of the vehicles.

Another feature of the invention involves the construction and operation of a pavement laying means on a movable crawler truck. The pavement laying means has a curved surface and a plurality of jacks which are vertically movable in order to adjust the shape of the curved surface. A microcomputer has stored curved surface shape data which correspond to the desired shape at measuring points along the travel path of the pavement laying means. A travel distance measuring device on the crawler truck sends signals to the microcomputer which, upon receiving such signals, generates output signals which control the jacks based on the stored curved surface shape data. Preferably, the curved surface is formed by a plurality of screed plates which are connected together by joints; and, links are provided to connect the screed plates to the jacks. Also, it is preferred that the jacks be of the screw type.

For a more complete description of a preferred embodiment of the invention, reference is made to the accompanying drawings and the detailed description which appears below.

BRIEF DESCRIPTION OF THE DRAWINGS

FIGS. 2, 3 and 4 are diagrammatic elevational views showing conventional means for supporting paving machines on sloped surfaces.

FIG. 5 is a diagrammatic elevational view showing one embodiment of the invention.

FIG. 6 is a front view of a portion of the apparatus shown in FIG. 5.

FIG. 7 is a view of a light receiving device used in the embodiment of FIG. 5.

FIG. 8 is a flowchart showing the operation of the control means in the FIG. 5 embodiment.

DETAILED DESCRIPTION

A first embodiment of the invention is shown in FIGS. 5–7. Referring first to FIGS. 5 and 6, it will be seen that two wires extend from the anchor vehicle B to the inclined paving machine M on the slope face F. The anchor vehicle B travels longitudinally along the uphill side A of the slope face.

Figure 1:
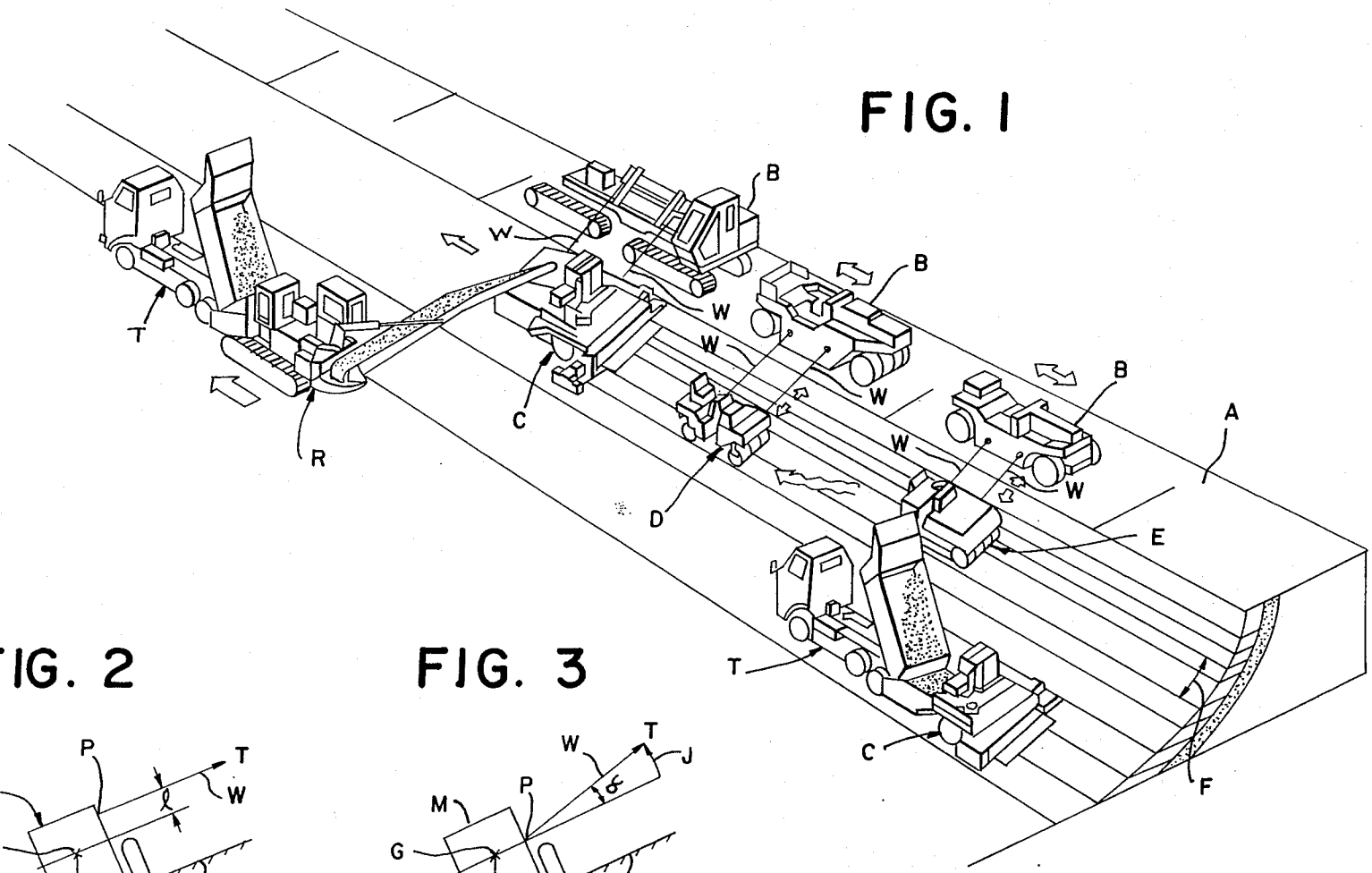
FIG. 1 is a cutaway perspective view showing an existing system for paving an inclined surface to which the invention is applicable.
Figure 2:
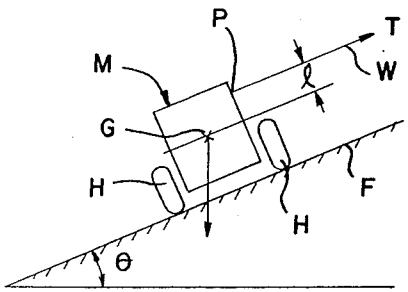
Figure 3:
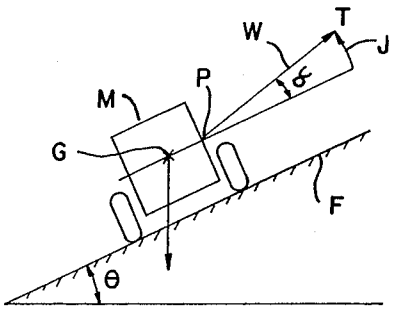

The paving machine B in FIG. 5 is similar to the machine shown in FIGS. 2–4. It has a main body which is supported by wheels H and wires W, the latter being fixed at the points P which are aligned with the center of gravity G. Therefore, when the wires W lie in the same direction as the inclination angle $\theta$, almost equal loads act on the right and left wheels H. A light projector 130 on the paving machine M emits a laser beam which is angularly adjustable so that it can be directed almost perpendicular to the line GL which is perpendicular to the slope face F and passes through the center of gravity G of the paving machine M.

The main body of the anchor vehicle B has independently steerable crawlers 103 and a main frame 101 mounted on the crawlers. A driver's cab 102, a wire feeding apparatus, a hydraulic pressure generator and other components are mounted on the frame 101. The wire feeding apparatus includes a winch 109 which feeds out or takes up the wire, a pair of arms 107 which are spaced apart and are pivotally mounted on fulcrums 120, guide sheaves 104 which are rotatably mounted on the arms 107, guide sheaves 105 which are rotatably attached to the fulcrums 120, and hydraulic piston-cylinder units 110 which are operable to adjust the angles and heights of the arms 107. The wires W from the winch 109 are wound around the guide sheaves 104 and 105, and they are connected to the paving machine M. The arms 107, guide sheaves 104 and units 110 provide a height adjusting means.

As shown in FIG. 6, the swinging ends of the arms 107 are connected together by a member 106. Therefore, only one hydraulic cylinder unit is required to move both arms synchronously, and only one winch 109 is provided.

A light receiving device 131 which receives the laser beam can be a conventional photosensitive cell which is attached at or near the center of the member 106. As shown in FIG. 5, the light receiving angle of the device 131 can be adjusted in order to receive the laser beam L at a right angle. In lieu of a single diode photosensitive device, it is also possible to use a light receiver 131a as shown in FIG. 7. In this device, point "0" is the preset position for receiving the laser beam. When the beam is received at point "+1" or "−1", the angle of inclination is changed upwardly or downwardly from one degree from the set point. In this case, therefore, the hydraulic piston-cylinder units 110 are driven by only "+1" or "−1" degree to change the inclination angles of the arms 107, thereby adjusting the feed-out heights of the wires. These heights can also be adjusted digitally or in an analog manner as described above. In any case, when the light receiving position of the device 131 or **131*a* deviates from the preset position, the control means generates a signal indicative of the deviation and sends it to the hydraulic unit 110** to extend or contract the unit.

The operation of the foregoing embodiment will now be explained in connection with FIG. 8. First, the cylinder unit 110 is manually operated to adjust the angle $\theta$ of the wire W until the angle between the wire W and the center of gravity line GL of the paving machine is substantially a right angle as shown in FIG. 5. The light receiving device **131*a* is adjusted so that laser beam L is received at the preset position, point "0". Next, the automatic operating switch is turned on (step S1). The anchor vehicle B and paving machine M are driven along the inclined surface, and a check is made to confirm that the angle of the paving machine, i.e., the angle of the laser beam, is at the set positional angle during the paving work (step S2). If the laser beam has deviated from the preset position, the control means determines the direction of deviation (step S3), and it sends a single indicative of the deviating direction to the cylinder unit 110 (step S4 and S5). The unit 110** is extended or contracted in response to this signal, thereby holding the wire feed-out height and the angle $\theta$ at a set value.

Figure 9:
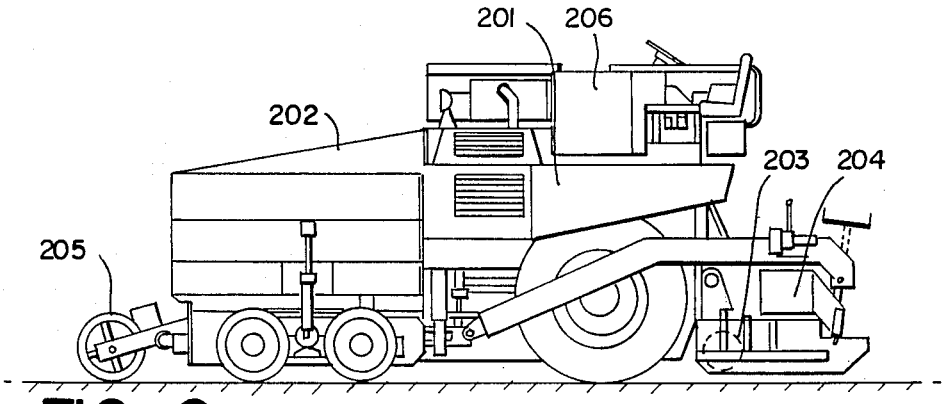
FIG. 9 is a side elevational view of a second embodiment of the invention.
Figure 10:
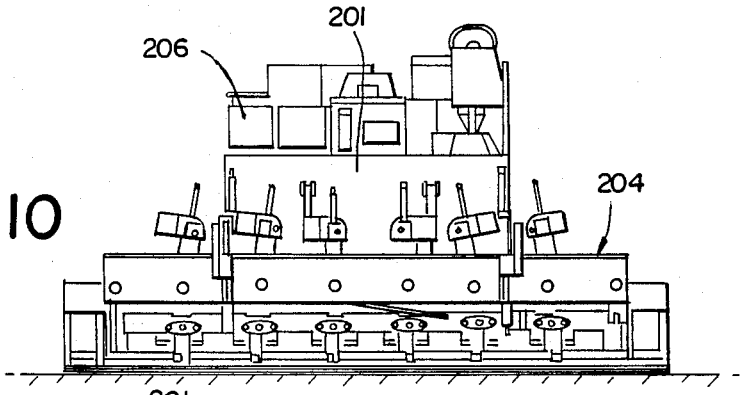
FIG. 10 is a rear view of the FIG. 9 embodiment.
Figure 11:
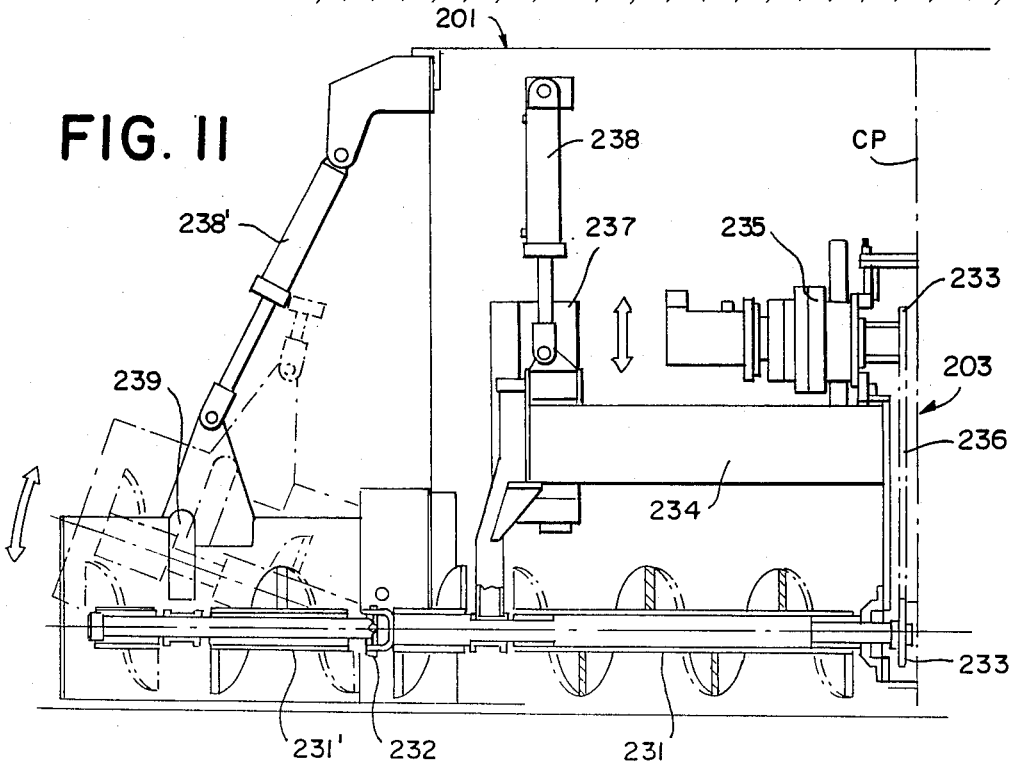
FIG. 11 is an enlarged front view of one side of a screw spreader used in connection with the second embodiment of the invention, the other side being a mirror image thereof.

The second embodiment of the present invention is illustrated in FIGS. 9–14. FIGS. 9 and 10 show a crawler truck or a tractor 201 which carries a hopper 202 for a paving material such as asphalt or the like. A screw spreader 203 for the paving material is disposed behind the tractor 201, and an apparatus 204 for uniformly laying the paving material is disposed behind the screw spreader 203. In front of the tractor 201, there is a rotatable travel distance measuring wheel 205 which rides in contact with the surface to be paved. A signel indicative of the rotational speed or displacement of the wheel 205 is input into a microcomputer 206 which calculates the travel distance.

Each side of the screw spreader 203 has two screws 231 and 231'0 which are serially arranged and coupled together by a universal joint 232. A sprocket 233 is fixed to the end of the screw shaft near the longitudinal central plane CP of the apparatus. The machine has a bracket 234 which carries a motor 235 for driving a chain 236 which is connected to the screwdriving sprocket 233. The motor 235 is reversible and its speed can be continuously changed.

The screws 231 and 231', the hydraulic motor 235 and other related components are all carried by the bracket 234. This bracket is vertically movable on a slide plate 237 by means of a first piston-cylinder unit 238. Such movement adjusts the height of the screws 231 and 231' from the roadbed surface. A second piston-cylinder unit 238' is also attached to the tractor 201 and is coupled with a swinging bracket 239 which rotatably supports the outboard screw portion. Therefore, by actuating the piston-cylinder unit 238', the angle of the outboard screw portion 231' relative to the ground is changed. Thus, the screw can change to conform approximately to the shape of the curved surface to be paved.

Figure 12:
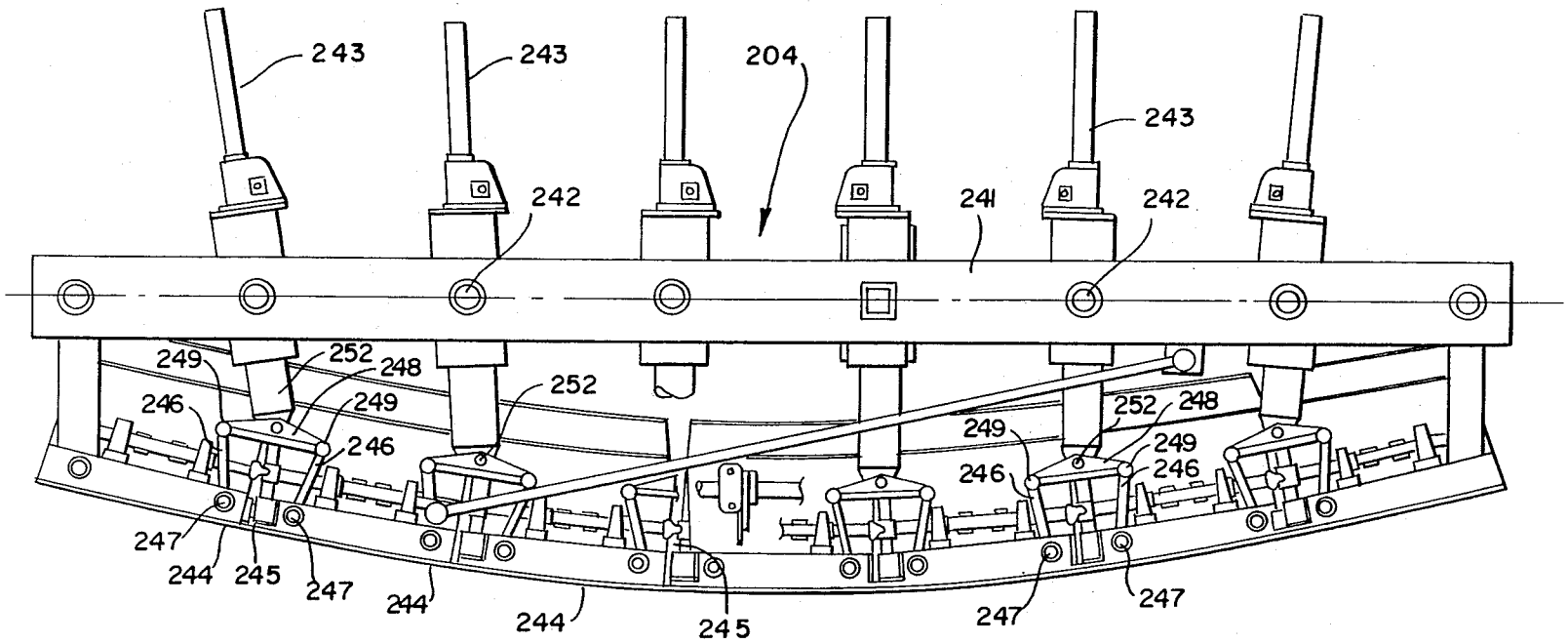
FIG. 12 is an enlarged rear view of a pavement laying apparatus used in connection with the embodiment of FIGS. 9–14.

The laying apparatus 204 is shown in FIG. 12 where it will be seen that it has a main beam 241 coupled with the tractor, a plurality of screw jacks 243 which are pivotally attached to the beam 241 by pins 242, and a plurality of screed plates 244 attached to the screw jacks.

Each screed plate 244 is made of a rectilinear member which has a length of about 40 to 60 cm. The screed plates are coupled together by ball joints 245. Arms 246 are connected to the screed plates 244 by pins 247; and, the upper ends of these arms 246 are connected by pins 249 to the ends of brackets 248. Each bracket 248 is connected by a pin 252 to the end of the screw jack 243. Therefore, the arms 246, brackets 248 and screed plates 244 constitute a type of link mechanism. By vertically moving the jacks 243, the screed plates 244 form a pseudo curved surface shape.

Figure 13:
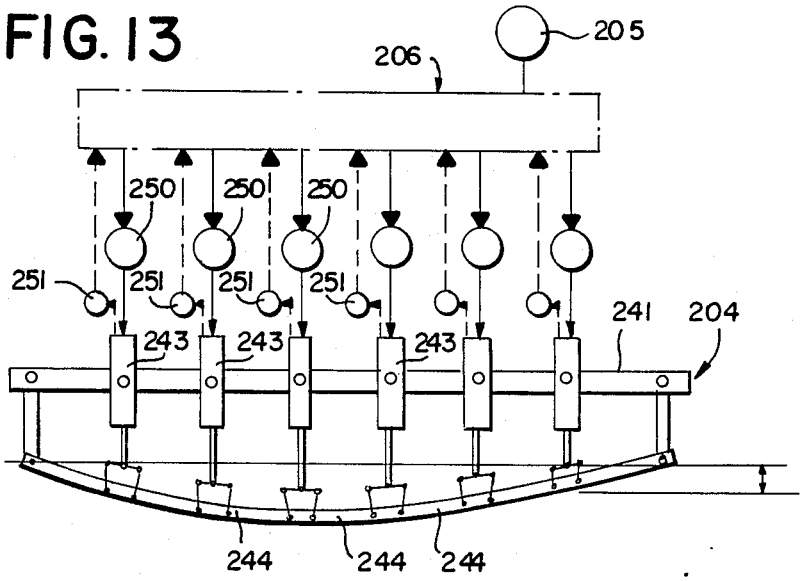
FIG. 13 is a rear view showing in diagrammatic fashion the means for controlling the shape of the FIG. 12 apparatus.

As shown in FIG. 13, a microcomputer 206 provides signals which control the formation of the curved screed surface. The curvature designed for the slope face at any predetermined point is stored in the microcomputer 206. The travel distance determined by the measuring wheel 205 shown in FIG. 6 is input to the microcomputer. When the travel distance increment becomes two meters or any other selected distance, signals indicative of the desired curvature at the screed position are output from the microcomputer 206 to motors 250 which extend or contact the screw jacks 243. The extension or contraction distance of each screw jack 243 is detected by a rotary encoder 251 and fed back to the microcomputer. This amount is automatically set into a command value x which has previously been stored. In this manner, the shapes of the cross sections to be paved are sequentially accurately formed in the screed every two meters along its travel.

Even when the command signals are generated every two meters, the screw jacks slowly extend or contract while the tractor advances. Therefore, the cross sectional shape of the surface to be paved is continuously smoothly formed without a stepwise change.

During operation of the embodiment of FIGS. 9–14, a paving material such as asphalt or the like is placed in the hopper 202 and is deposited in proper quantities on the slope face by a feeder or the like. The paving material is tranversely spread by the screw spreader 203 by the screws 231 and 231' which are rotated by the motor 235. Simultaneously, the tractor 201 is steered and the paving material is uniformly laid onto the slope face by the apparatus 204. To lay the material uniformly, it is important to control the shape of the screed formed by plates 244 in response to signals from the microcomputer 206.

Figure 14:
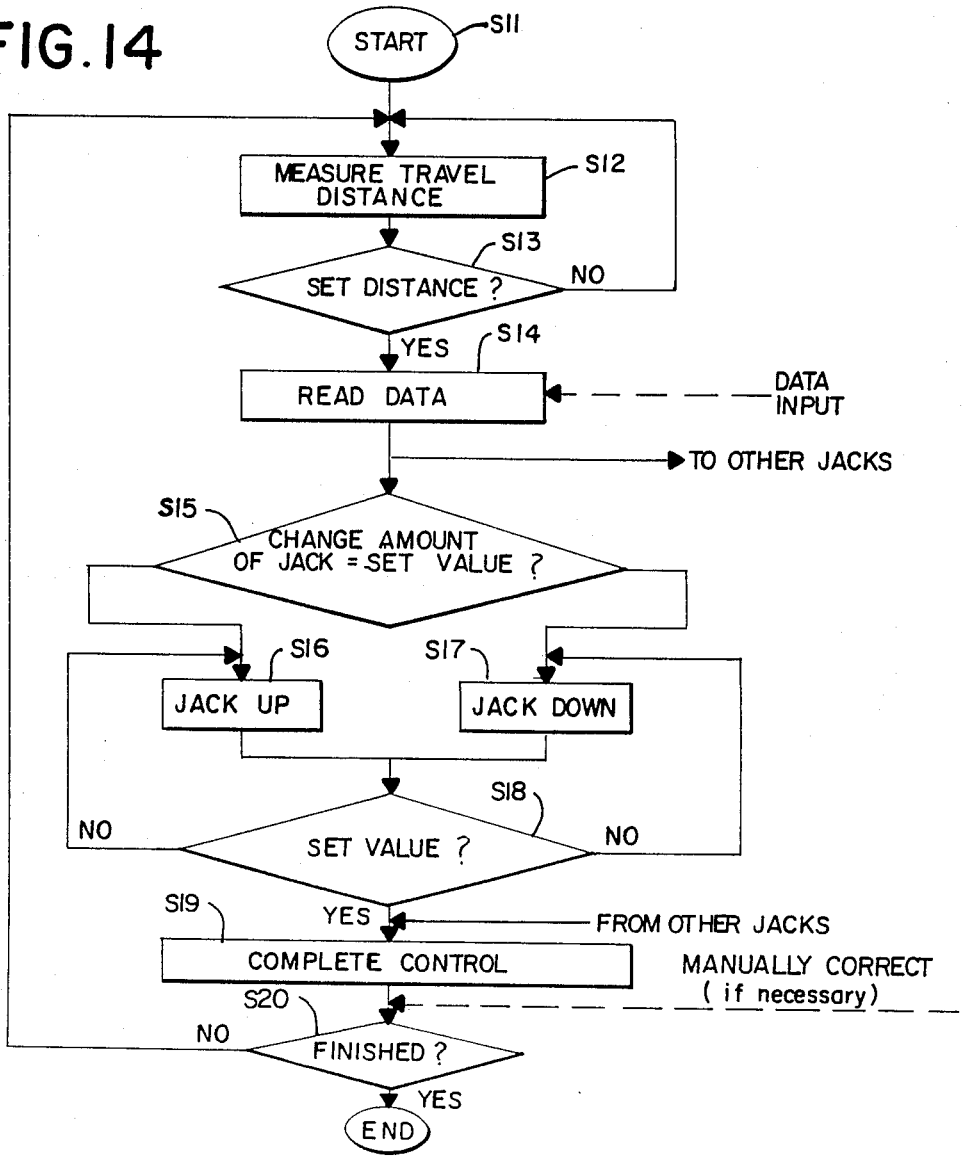
FIG. 14 is a flow chart showing the operation of a microcomputer used in the embodiment of FIGS. 9–14.

The operation of the microcomputer 206 is shown in the flow chart of FIG. 14. The paving work is started from a predetermined position (step S11). The microcomputer receives the data indicative of the rotational speed or displacement of the measuring wheel 205, and it calculates the travel distance (step S12). A check is made to determine if the travel distance, i.e., the distance of the machine along the roadbed, has reached a set incremental value such as two meters (step S13). If NO, the processing routine is returned to Step S12. If YES, the curvature data which has previously been stored in the computer is read out (step S14). This data is also simultaneously supplied to the motors 250 to drive the screw jack 243. The expansion or contraction distance of each jack 243 is compared with a set value on the basis of the output data (step S15). The motors 250 are driven so that the expanding or contracting amount of each jack 243 is equal to the set value, thereby moving the jack 243 up or down as appropriate (step S16 or S17). The jack is driven until it reaches a set value and a check is made to see if it has reached the set value or not (step S18). If the jack has reached the set value (YES in Step 18), the control of the jack and the setting of the screed plate is complete (step S19). By repeating the foregoing operation at each incremental distance of two meters, the paving work is completed (step S20).

Persons who are familiar with the field of the invention will recognize that it is susceptible to numerous modifications and variations which differ considerably from the disclosed embodiment. Therefore, it is emphasized that the invention is not limited only to the disclosed embodiments but is embracing of modifications and improvements which fall within the spirit of the following claims.

We claim:

1. A method for paving a three-dimensional curved surface with a crawler truck which is associated with a travel distance measuring means for providing distance-indicating output signals which are indicative of the position of the crawler truck along its path of travel, pavement laying means attached to the crawler truck for uniformly laying a paving material, said pavement laying means having a surface which is curved in a vertical plane tranverse to said path of travel and a plurality of jacks which are vertically movable, transversely pivotable, and are operable to adjust the shape of the curved surface, and a microcomputer means provided with stored curved surface shape data which correspond to measuring points along the travel path of the pavement laying means, said method including the steps of receiving, at said microcomputer means, said output signals from the travel distance measuring means; generating computer output signals based on said curved surface shape data; and, controlling the jacks based on said computer output signals to change the curvature of said curved surface.

2. A method according to claim 1, wherein the curved surface is formed by a plurality of screed plates, said screed plates being movable relative to each other, link means which connect the screed plates to the jacks, each of said link means including a bracket and arms, each said bracket being pivotally connected to an actuator, and each of said arms is pivotally connected to the bracket and a screed plate.

3. A method according to claim 1, wherein a screw spreader means is mounted forwardly of the curved surface for spreading a paving material laterally, said screw spreader means including at least two screws which are moved vertically by automatic control.

4. A method according to claim 3, wherein the curved surface is formed by a plurality of screed plates, said screed plates being movable relative to each other, link means which connect the screed plates to the jacks, each of said link means including a bracket and arms, each said bracket being pivotally connected to an actuator, and each of said arms is pivotally connected to the bracket and a screed plate.

5. A system for paving a three dimensional curved surface comprising a crawler truck, a travel distance measuring means for providing output signals indicating the position of the crawler truck along its path of travel, and pavement laying means attached to the crawler truck for uniformly laying a paving material, said pavement laying means having a surface which is curved in a vertical plane traverse to said path of travel, and a plurality of jacks which are vertically movable, transversely pivotable, and are operable to adjust the shape of the curved surface, a microcomputer means provided with stored curved surface shape data which correspond to measuring points along the travel path of the pavement laying means, said microcomputer means receiving said output signals from the travel distance measuring means, said microcomputer means also generating computer output signals which control the jacks based on said stored curved surface shape data to change the curvature of said curved surface.

6. A system according to claim 5 having a plurality of screed plates which together form said curved surface, said screed plates being connected to each other by joints so as to be movable relative to each other, and links which connect the screed plates to the jacks.

7. A system according to claims 6 wherein said jacks are screw type jacks.

8. A system according to claim 5, wherein the curved surface is formed by a plurality of screed plates, said screed plates being movable relative to each other, link means which connect the screed plates to the jacks, each of said link means including a bracket and arms, each said bracket being pivotally connected to an actuator, and each of said arms is pivotally connected to the bracket and a screed plate.

9. A system according to claim 5 wherein a screw spreader means is mounted forwardly of the curved surface for spreading a paving material laterally, said screw spreader means including at least two screws which are moved vertically by automatic control.

10. A system according to claim 9, wherein the curved surface is formed by a plurality of screed plates, said screed plates being movable relative to each other, link means which connect the screed plates to the jacks, each of said link means including a bracket and arms, each said bracket being pivotally connected to an actuator, and each of said arms is pivotally connected to the bracket and a screed plate.

* * * * *